US006695187B1

(12) United States Patent
Dunkle

(10) Patent No.: US 6,695,187 B1
(45) Date of Patent: Feb. 24, 2004

(54) PORTABLE RADIO CARRYING CASE

(76) Inventor: Gregory D. Dunkle, R.R. 1, Box 1350, Wayne, WV (US) 25570

( * ) Notice: Subject to any disclaimer, the term of this patent is extended or adjusted under 35 U.S.C. 154(b) by 0 days.

(21) Appl. No.: 10/283,964

(22) Filed: Oct. 30, 2002

(51) Int. Cl.[7] ..... A45F 3/04

(52) U.S. Cl. ..... 224/601; 224/605; 224/623; 224/638; 224/647; 224/930

(58) Field of Search ..... 224/601, 604, 224/605, 623, 624, 625, 626, 637, 638, 647, 648, 649, 671, 674, 675, 930

(56) References Cited

U.S. PATENT DOCUMENTS

| | | | | | |
|---|---|---|---|---|---|
| 2,396,118 | A | * | 3/1946 | Ohlemeyer | 224/623 |
| 4,125,212 | A | * | 11/1978 | Courchesne | 224/601 |
| 4,775,083 | A | | 10/1988 | Burger et al. | |
| 4,836,428 | A | * | 6/1989 | Evans et al. | 224/674 |
| D370,776 | S | * | 6/1996 | Frey | 224/624 |
| 5,653,367 | A | * | 8/1997 | Abramson | 224/624 |
| 5,813,584 | A | * | 9/1998 | Mauser | 224/649 |
| 5,816,459 | A | | 10/1998 | Armistead | |
| 5,862,526 | A | * | 1/1999 | Longcor et al. | 224/605 |
| 5,947,352 | A | | 9/1999 | Parsons | |
| 6,182,878 | B1 | * | 2/2001 | Racca | 224/604 |
| 6,247,623 | B1 | | 6/2001 | Walters | |
| 6,352,186 | B1 | | 3/2002 | Endo | |
| 6,375,056 | B1 | * | 4/2002 | Henri | 224/623 |
| 6,390,346 | B1 | * | 5/2002 | Thomas | 224/605 |
| 6,568,576 | B1 | * | 5/2003 | Godshaw et al. | 224/647 |

* cited by examiner

*Primary Examiner*—Gary E. Elkins
(74) *Attorney, Agent, or Firm*—Bowles Rice McDavid Graff & Love, PLLC; John J. Giblin, Jr.

(57) ABSTRACT

A carrying case for a portable two-way radio and designed to be attached to various points or straps on a Type V floatation vest used as a work vest by crew members on tug boats, tow boats and other inland or intra-coastal waterway vessels. The carrying case is comprised of a receptacle and strap. The receptacle is formed of a flexible material and has an open top and front, rear, bottom and two side surfaces. The strap is mounted longitudinally to the rear surface, and passes through a D-ring attached to the top edge of the front surface. The strap has fastening means on either end for securing the two ends together. The case is then attached to a work vest by passing the strap through an attachment point on the work vest above the case, then through another attachment point below the case. The ends of the strap are then tightened by the fastener means. In so tightening, the strap cinches the D-ring and the top edge of the front surface against the top edge of the rear surface, forming a closure of the receptacle.

7 Claims, 2 Drawing Sheets

PORTABLE RADIO CARRYING CASE

BACKGROUND

1. Field of the Invention

The invention disclosed herein relates to carrying cases for portable communication devices.

2. Description of Related Art

In the maritime industry, crew members of tow boats, tug boats, barges and other vessels operating in inland and intra-coastal waterways carry two-way radios for communicating with other crew members and the vessel's operating officer to coordinate and perform necessary manual tasks and jobs on the vessel. These crew members are also required, under U.S. Coast Guard regulations, to wear work vests which meet Type V personal floatation requirements when working on deck of these vessels. They are also wearing work gloves to protect their hands while handling lines and performing other manual tasks.

The work vest is typically constructed of three panels of plastic closed-cell foam, each panel having a substantial thickness, typically of about two inches. The three panels are interconnected by an arrangement of straps, allowing the vest to be worn by a crew member like a vest.

While wearing the work vest, the crew member must also carry and use a two-way radio to communicate with other crew members. The radio should be carried in a manner which allows for minimal, one-handed operation of the transmit button and the other controls of the radio, so as to minimize interference with the varying manual duties necessary on these vessels. A number of models are available, but the means for wearing or carrying them is often incompatible with wearing the work vest and performing the vessel's duties.

One type of radio has an integral microphone and speaker, and must be positioned near the crew member's mouth while pressing the transmit button to talk to others. This type often is carried in a case having a clip or loop, allowing the radio's case to be worn on the crew member's pants belt. These are usually impractical for a crew member, as the work vest will often cover the radio or its antennae and the radio cannot be easily removed from its case, held and operated in one hand, especially when wearing gloves.

Another type of radio has a microphone/speaker separate from the main body of the radio. The microphone has a clip, which can be attached to a strap or other part of the work vest near the speaker's mouth and which is connected by an electrical cord to the main body of the radio, which again is worn on the belt. This permits easier one-handed operation. However, the cord often tangles or interferes with the work the crew member is trying to perform, and the controls and antennae on the main body of the radio are still blocked or covered by the vest.

Various radio carrying cases are available for the integral type radio which have holsters, harnesses or straps allowing the radio case to be worn on or about the wearer's chest. However, these often cannot be worn by crew members on the exterior of the required work vest. If they can, they are often positioned inconveniently due to the construction of these work vests. These types of carrying cases also do not provide sufficient protection for the radios from water spray or other environmental hazards.

A carrying case for a two-way radio is desirable by crew members of inland water vessels which may be attached to the standard work vest, as required by the U.S. Coast Guard, which may be positioned conveniently, and which facilitates easy operation with a single hand.

SUMMARY OF THE INVENTION

The present invention is directed to a carrying case for an integral two-way radio which can attach to a standard Type V personal floatation work vest on one of the front panels by a vertical strap in a convenient location and allow easy, one-handed operation of the radio. A radio carrying case having features of the present invention comprises a receptacle made of flexible, durable, outdoor material formed into a front surface, rear surface, two side surfaces, a bottom surface and an open top formed by the top edges of the front, rear and two side surfaces; a D-ring attached to the top edge of the front side, and a strap attached longitudinally to the rear side. The strap is attached through two loops sewn or riveted to the exterior of the rear surface of the case or by sewing or riviting directly to the rear surface. The carrying case can, in one embodiment, hold the radio in an inverted position, which directs the antennae downward less obtrusively and protects the radio from water spray and other elements of the environment. The strap also functions as part of the closure for the receptacle, automatically cinching the top edges of the front and rear surfaces of the case closed from the weight of the radio, by passing the strap through the D-ring mounted on the top edge of the front surface. In the preferred embodiment, the carrying case has a perforated, clear window in the front surface to facilitates sound passage between the radio's speaker or microphone and the outside. Apertures are also provided in the left and right surfaces for facilitating operation of the radio's talk, volume, squelch and other controls.

DETAILED DESCRIPTION OF THE INVENTION

Figure 1:
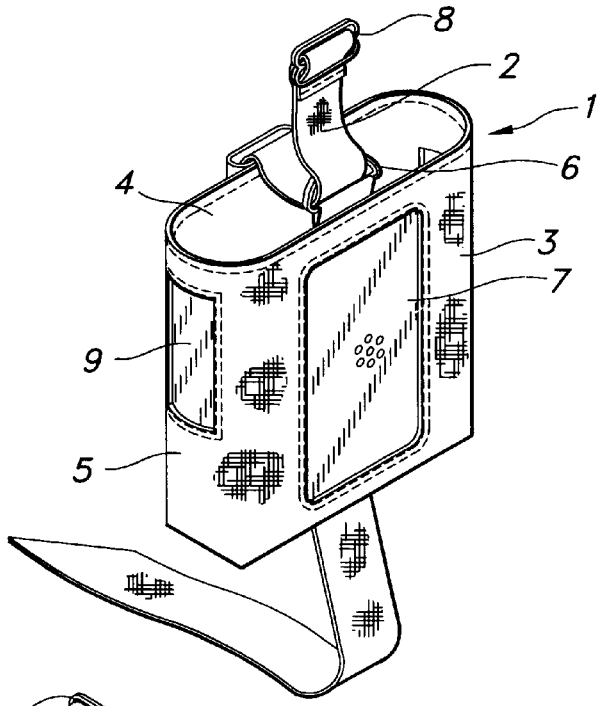
FIG. 1 is a perspective view of the front of the radio carrying case.
Figure 2:
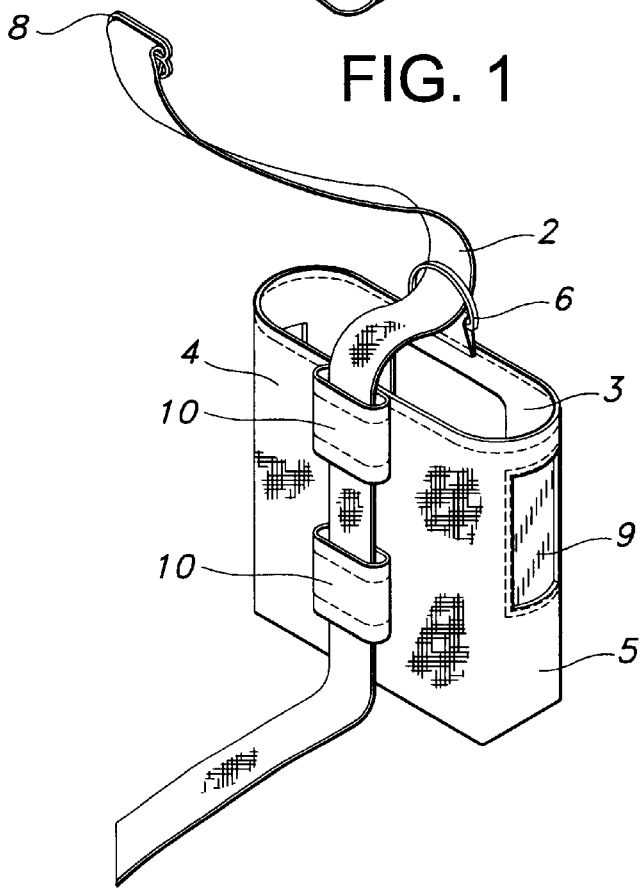
FIG. 2 is a perspective view of the rear of the radio carrying case.

With reference to FIGS. 1 and 2, the invention disclosed is a carrying case for a portable radio or other electronic device, comprised of a receptacle 1 with a strap 2 for attaching the carrying case to an outer garment, such as a work vest 13 worn by crew members of tow boats, tug boats, barges and other vessels navigating on the inland and intra-coastal waterways.

The receptacle 1 is constructed of vinyl, canvas, nylon taffeta or other flexible, durable, outdoor fabric or material. The fabric or material is cut, folded and sewn or seamed to form the receptacle 1, providing a front surface 3, a rear surface 4, and two side surfaces 5 and a closed bottom surface. The carrying case is fabricated by cutting, folding and sewing or seaming the selected material into the desired dimensions. The top of the receptacle 1, formed by the top edges of the front surface 3, rear surface 4 and two side surfaces 5, is left open to receive the radio or other electronic devise therein. A "D-ring" 6 is attached to the top edge of the front surface 3 by a loop constructed of webbing, the loop enclosing the straight section of the D-ring 6, thereby providing a semi-circular opening in a plane parallel to the front surface 3.

The front surface 3 has an aperture or opening 7, within which is disposed a clear window made of clear plastic which is perforated to allow sound to emanate to or from the speaker or microphone of the radio carried within the case. The two side surfaces 5 may have disposed within them apertures 9 of various dimensions, as needed to accommodate the controls of a particular radio model for which the case is fabricated. Some of the apertures 9 in the side surfaces 5 may have clear windows disposed within them.

The strap 2 is made of flexible webbing, preferably nylon, and functions both to secure the carrying case to a work vest or other outer garment and, in cooperation with the D-ring 6, to close or cinch together the top edges of the front 3 and rear surfaces 4. The strap 2 is attached by one of two means to the exterior of the rear surface 4. The strap 2 may be sewn directly to the exterior of the rear surface 4 or, in the preferred embodiment, pass through a single or plurality of wide loops 10 sewn or riveted to the exterior of the rear surface 4. This configuration permits easier adjustment of the vertical position of the carrying case when affixed to a work vest.

On either end of the strap 2 are disposed fastening means for adjustably fastening the ends of the strap together. The preferred embodiment uses as the fastening means a bar slide 8, attached on the end of the strap 2 proximate to the top of the carrying case and the D-ring 6. The other end of the strap 2 in the preferred embodiment is tapered to facilitate securing into the bar slide 8. The fastening means on the ends of the strap 2 provided in other embodiments comprise the same bar slide 8 at one end and a square cut at the other end; a pair of O-rings or D-rings at one end and a tapered or square cut at the other end; one strip of a matching hook-and-loop fastening strip (e.g., Velcro®) on either end of the strap 2; a metal or plastic tab at one end, which fits into a corresponding metal or plastic buckle at the other end; or a variety of snaps, hooks or clasps.

In addition to attaching the carrying case to a work vest, the strap 2 functions to close the top of the receptacle 1, which is accomplished by passing the strap 2 across the top opening of the receptacle 1 and through the opening in the D-ring 6. The strap 2 is then secured to a work vest, its ends then fastened and tightened together. When the tension on the strap 2 is increased, the top edge of the front surface 3 is cinched against the top edge of the rear surface 4 by the D-ring 6. The contents in the receptacle 1 remain securely inside the receptacle 1 so long as tension in the strap 2 maintains the closure of the top edges of the front 3 and rear surfaces 4.

Figure 3:
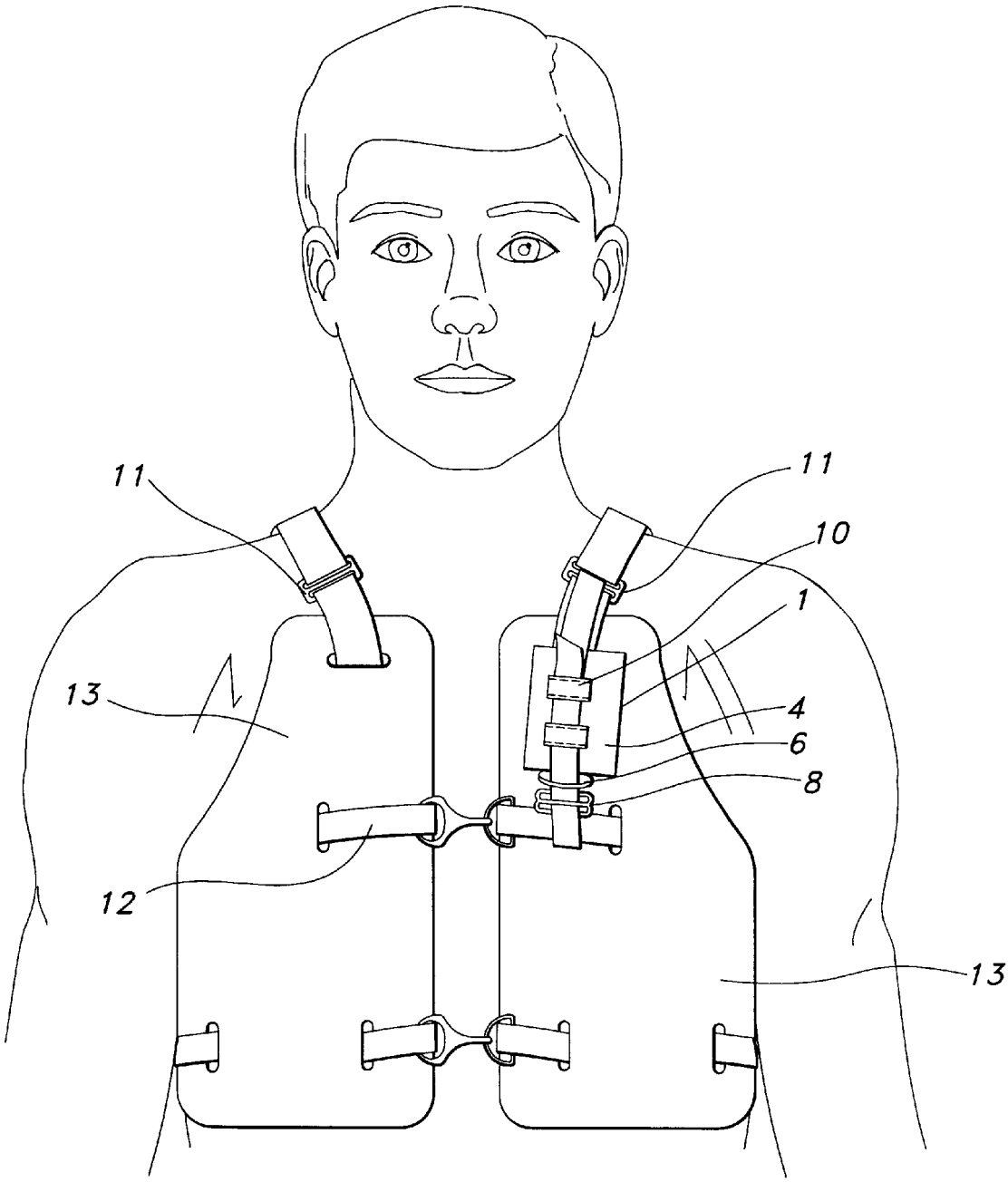
FIG. 3 is a perspective view showing the radio carrying case attached to a work vest by the strap.

As shown in FIG. 3, the carrying case may be worn by attaching it to a work vest 13 at a desired mounting point on the work vest 13 by passing one end of the strap 2 around or through attachment points on the work vest 13 above and below the desired mounting point. In the preferred embodiment, the carrying case is positioned and the strap 2 is attached in such a manner that the top of the carrying case is orientated downward and the front surface 3 is orientated towards the work vest 13. The desirable mounting point on the work vest 13 is typically at a point slightly below and to the left of the chin of the user. At this point, the user can easily speak into the radio at normal volumes while operating the radio by grasping it with his closest hand, twisting the case slightly to direct the front surface 3 of the carrying case slightly away from the work vest floatation panel, and pressing the talk control on the radio. The position of the mounting point will also maintain the radio above water, assisting in the user's rescue in the event the user falls overboard from his vessel.

The typical Type V floatation work vest 13 consists of three floatation panels, two in front in one in back of the wearer, which are secured to each other by an arrangement of webbing and straps. The typical work vest 13 has a double-O buckle 11 above each of the front floatation panels. This buckle provides a convenient upper point of attachment for the carrying case, to which the carrying case may be attached by passing the tapered end of the strap 2 up and behind and back down around the center bar of the double-O buckle 11. The front floatation panels also have a pair of horizontal securing straps, to which are disposed buckles for securing the two front floatation panels together. The upper securing strap 12 on the left floatation panel provides a convenient lower point of attachment for the carrying case, by passing the tapered end of the strap 2 down behind the upper securing strap 12, then back up in front of the upper securing strap 12. The tapered end of the strap 2 is secured into the bar slide 8 on the other end of the strap 2 and the tension adjusted so as to hold the carrying case firmly against the floatation panel of the work vest 13. In this orientation, the antennae of the radio is directed unobtrusively downward and the face of the radio is protected from environmental and impact hazards by the work vest floatation panel.

In the embodiment utilizing loops 10 for securing the strap 2 to the rear surface 4, the strap 2 may be adjusted through the loops 10, the D-ring 6 and the two attachment points so as to dispose the fastening means to a convenient position while maintaining the disposition of the carrying case at the desired mounting point.

I claim:

1. A carrying case for an electronic device or radio, comprising:

a. a receptacle formed from a flexible material, having a front surface, a rear surface, two side surfaces and a bottom surface, each surface having an exterior and an interior side, wherein the front surface, rear surface and two side surfaces each having a top edge, defining a top opening into the receptacle;

b. a D-ring flexibly attached by its straight portion to the top edge of the front surface;

c. a strap longitudinally attached to the exterior of the rear surface and having two ends, one end of which is disposed through the opening of the D-ring to cinch together the top edges of the front and rear surfaces; and d. fastening means disposed on the ends of the strap for adjustably fastening the two ends of the strap together.

2. The carrying case of claim 1, wherein the strap is attached rigidly to the case by sewing or riveting.

3. A carrying case for an electronic device or radio, comprising:

a. a receptacle formed from a flexible material, having a front surface, a rear surface, two side surfaces and a bottom surface, each surface having an exterior and an interior side, wherein the front surface, rear surface and two side surfaces each having a top edge, defining a top opening into the receptacle;

b. one or more loops rigidly disposed on the exterior side of the rear surface, wherein the axes of the loops are aligned longitudinally with the receptacle and collinearly with each other;

d. a D-ring flexibly attached by its straight portion to the top edge of the front surface; and e. a strap having two ends, wherein the strap is disposed through the interior of the loops and through the interior of the D-ring to cinch together the top edges of the front and rear surfaces, f. fastening means disposed on the ends of the strap for adjustably fastening the two ends of the strap together.

4. The carrying case of claim 1 or 3, further comprising a work vest, to which the strap is adjustably connected at a plurality of attachment points on the work vest and the ends of the strap are fastened together using the fastening means.

5. The carrying case of claim 1 or 3, further comprising an aperture in the front surface, the opening of said aperture having fixed within it a clear flexible window.

6. The carrying case of claim 5, wherein at least one of the apertures in the side surfaces has fixed within it a clear flexible window.

7. The carrying case of claim 1 or 3, further comprising one or more apertures in the side surfaces to facilitate manual operation of the controls of the radio.

* * * * *